United States Patent [19]

Ibrahim

[11] Patent Number: 4,554,795

[45] Date of Patent: Nov. 26, 1985

[54] COMPRESSOR OIL RETURN SYSTEM FOR REFRIGERATION APPARATUS AND METHOD

[75] Inventor: Fayez F. Ibrahim, Niles, Mich.

[73] Assignee: Tyler Refrigeration Corporation, Niles, Mich.

[21] Appl. No.: 551,430

[22] Filed: Nov. 14, 1983

[51] Int. Cl.[4] ..... F25B 43/02

[52] U.S. Cl. ..... 62/175; 62/471; 62/510

[58] Field of Search ..... 62/194, 192, 503, 510, 62/175, 471; 137/888; 418/84

[56] References Cited

U.S. PATENT DOCUMENTS

| | | | |
|---|---|---|---|
| 2,350,408 | 6/1944 | McGrath | 62/510 |
| 4,182,136 | 1/1980 | Morse | 62/503 |
| 4,184,341 | 1/1980 | Friedman | 62/510 |

*Primary Examiner*—William E. Wayner

[57] ABSTRACT

An improved oil return system for use with closed circuit mechanical refrigeration systems having multiple compressors. The oil return system is responsive to the flow of refrigeration gas to the individual compressors and enables an optimum flow of crank case oil to each of the multiple compressors. The system is based on the use of oil pick-up means for each of the suction lines connected between the suction manifold and each of the compressors. This pick-up means comprises a venturi tube which provides for the flow of oil through each of the suction lines responsive to the flow of refrigerant gas therethrough. The venturi tube has an outlet end positioned in a downstream orientation with respect to the flow of refrigerant gas through a surrounding suction drop sleeve.

18 Claims, 6 Drawing Figures

COMPRESSOR OIL RETURN SYSTEM FOR REFRIGERATION APPARATUS AND METHOD

BACKGROUND OF THE INVENTION

The present invention relates to a closed cycle refrigeration system for use in refrigerated installations. In particular, it relates to an oil return means which permits crank case oil from the compressors of such a refrigeration system to be returned to the various compressor crank cases dependent upon the requirements for oil flow thereto.

Commercial refrigeration systems operate through the use of compressors which draw in refrigerant gas through a suction line, compress the gas, and then discharge high pressure gas to a condenser means where it is condensed to a liquid. Thereafter the liquified refrigerant is put through an expansion valve into one or more evaporator coils which are the low temperature elements in the closed circuit. Thereafter the refrigerant gas formed during evaporation of the liquid refrigerant is returned to the compressor by a suction line. In many commercial systems multiple compressors are employed with the same series of evaporator coils in order to provide for variable refrigeration loads which are imposed upon the refrigeration system. In these systems the refrigerant gas from the evaporators is gathered in a suction manifold which is in turn connected to separate suction lines. Such variable refrigeration loads can occur due to frequency of use of the refrigerated installations, for example refrigerated display cases in supermarkets or can occur due to variable ambient heat and humidity conditions. In such systems the multiple compressors are controlled by a control means which is sensitive to the variable refrigeration loading conditions.

In the refrigeration art it is considered important to distinguish between systems operating with only a single compressor and those operating with multiple compressors due to the greater complexity of refrigerant flow lines and control means in the case of the latter. Another reason to make this distinction is that commercially employed compressors are driven by motors connected to crank shafts which are in turn connected with one or more pistons which perform the compression function. The operation of the crank shafts and pistons requires a lubricating oil flow which can be easily controlled in the situation where a single compressor is employed in a refrigeration system. When multiple compressors are to be used in a refrigeration system in order to accommodate variable refrigeration loads, the handling of the flow of lubrication oil becomes somewhat more involved.

During the operation of a refrigeration system having multiple compressors, lubricant oil in the crank case oil bath is entrained in the refrigerant gas flow into the high pressure flow line leading away from the compressors. This oil then coats the entire inner surface of the refrigeration system and accumlates in certain of the components thereof. Provision must then be made for returning the accumulated lubricating oil to the crank cases of the compressors in a manner which provides an optimum supply of oil to each of the compressors. In refrigeration systems where some of the compressors are only operated periodically in response to variable refrigeration loading, the return flow of lubricating oil can be a particular problem. If the return oil flow occurs continuously during the operation of the system which is powered by less than all of the multiple compressors, the crank case of the non-operating compressor can overfill with oil which then can cause compressor damage during start-up.

A widely used commercial type of refrigeration system operating with multiple compressors connects the individual suction lines to each of the compressors from the bottom portion of the suction manifold in the system so that the oil layer in the bottom thereof is siphoned off continuously to each of the compressors. This type of continuous oil flow through siphoning results in the above described problem.

Other commercial systems utilize oil separators to separate most of the oil from the high pressure discharge lines connected to the compressors and to then return this oil to the compressor crank cases through oil floats which are used to allow the proper amount of oil to flow to individual crank cases. Oil reservoirs have been designed with sight glasses to assure that the systems can be checked for adequate oil levels depending upon different refrigeration loads.

In the art of refrigeration systems the use of flooded types of evaporators causes a particular problem at partial refrigeration loads in that the gas velocities through the evaporators are too low to entrain and return lubricating oil to the compressor. Normally at the termination of a defrost cycle the oil in the evaporator will be driven back to the suction manifold. This oil will flow in equal proportion to all the compressors, including the idle ones. Therefore high oil levels may develop in the idle compressor(s). This may result in damage of these idle compressor(s) on start-up. For this reason it is necessary to evolve some type of means to separate the entrapped oil and to return such oil to the compressor crank case.

U.S. Pat. No. 2,145,721 to Hall describes a flooded evaporator which has a header formed therein with a suction conduit for the transport of oil mixed with vaporised refrigerant. Such an evaporator is constructed for use with a single compressor.

Another problem which has arisen in the refrigeration art is that the lubricating oil which is entrained with the refrigerant gas flow collects in certain components within the refrigeration system and must then be fed back into the refrigerant flow line leading into the compressor in order to correctly proportion the lubricating oil with respect to the flow of the refrigerant. Such systems operate for recombining the lubricant oil with the refrigerant in a way to preserve a workable proportion of the two components. These systems have been involved with refrigeration systems having single compressors. Representative of the solutions to this problem are U.S. Pat. Nos. 2,021,691 to Kenney; 2,121,253 to McGuffey; 1,899,378 to Zouck et al.; and 3,111,819 to Williams.

One component of a refrigeration system in which lubricating oil accumulates is an anti-slugging tank such as shown in U.S. Pat. No. 3,180,567. An oil flow tube is placed within the tank in order to provide a passage for the accumulated lubricating oil into the compressor casing. Another system of a similar type is shown in U.S. Pat. No. 3,177,680 to Rasovich et al.

U.S. Pat. No. 3,438,218 to O'Neil discloses a flooding type evaporator which contains a centrally disposed tube having baffles thereon through which lubricating oil is entrained with the refrigerant gas flow in order to provide for the lubricating oil flow to compressor 2.

U.S. Pat. No. 2,663,164 to Kurtz shows a tube 15 for interconnecting two compressors located at different vertical positions so that a constant oil level is maintained in the higher of the two compressors. U.S. Pat. No. 2,042,558 to Steenstrup shows an arrangement for collecting lubricating oil which is lighter than the liquid refrigerant from the surface of the liquid in a flooding type evaporator, and hence is similar to the above-referenced Hall patent. U.S. Pat. No. 2,614,402 to Swart shows yet another means for returning lubricating oil to a compressor 2.

U.S. Pat. Nos. 4,141,223 and 4,142,380, both to Dyhr and Nissen, show an encapsulated compressor with a centrifugal separator 22 attached thereto which accumulates both liquid refrigerant and oil in its bottom section.

U.S. Pat. No. 3,276,215 to McDonell shows a multiple compressor system which has a common oil return line 22 which feeds oil to all of the compressors as a group.

The above referred to patents show that there has not been a sufficient appreciation of the problem of providing for intermittent oil flow to a series of multiple compressors which are operated periodically and individually in response to variable refrigeration loading. Such oil return means must also operate intermittently in order to prevent the accumulated oil in the system from flowing continuously into one or more of the compressors which is not then in operation. If provision for such intermittent oil return is not made, the crank case of the non-operated compressors will fill with oil to an unacceptably high level. Such means for intermittent oil return flow should be simple in construction and avoid mechanically operating valves. The above patents have not recognized the oil return flow problem and have not generated solutions to this problem.

SUMMARY OF THE INVENTION

The present invention provides an improved oil return system for multiple compressors used in a closed circuit mechanical refrigeration system. The oil flow to the individual compressors in this system is responsive to the flow of refrigeration gas through the individual compressors, and eliminates a problem in the prior art of continuous in-flow to the crank cases of compressors which are not operating.

A central feature in the oil return system disclosed herein is the provision of an oil pick-up means for each suction line connected between the suction manifold and each of the compressors used in the refrigeration system. The oil pick-up means permit the flow of oil through the suction line responsive to flow of refrigerant gas therethrough. In this manner the return flow of oil from the suction manifold to the compressor crank cases is made to be responsive upon the refrigerant gas flow into the various compressors.

The oil pick-up means comprises a venturi tube having an outlet end thereof positioned in a downstream orientation with respect to the flow of refrigerant gas through a suction drop tube. The venturi tube provides for the controlled flow of refrigerant gas from the suction manifold into each of the suction lines.

If desired, the oil pick-up means need only be used with respect to the compressors in the system which have the greatest percentage of idle time. The frequently used compressors can therefore have a continuous oil flow into the crank cases from the suction manifold. It is, however, required to install oil pick-up means on each of the suction lines leading into the multiple compressors within a refrigeration system when the compressors are programmed for automatic load rotation which is conventional practice.

It is therefore an object of the present invention to provide a closed circuit mechanical refrigeration system with an oil return system in which the return flow of oil from the suction side of the system to the compressors is responsive to flow of refrigerant gas through the separate suction lines.

Another object is to provide an improvement for a closed circuit refrigeration system of the type described herein.

Yet another object of the present invention is to provide a method of operating a closed circuit refrigeration system wherein an oil return system of the type described provides for return oil flow responsive to the flow of refrigeration gas through the separate suction lines.

A further object of the present invention is to provide an oil return system in which the return flow of oil is responsive to the flow of refrigeration gas in the suction lines of a wide variety of closed circuit mechanical refrigeration systems since such systems may have many additional features in sub-systems, including receiver by-pass means, head pressure maintenance means, mechanical sub-cooling means, separate heat recovery coils, and other advanced energy savings features.

Another object is to provide an oil return system in which the functional elements thereof are located internally within the components of the refrigeration system in order that the potential for refrigerant leakage from the system is minimized.

DESCRIPTION OF THE PREFERRED EMBODIMENTS

The preferred embodiment of the present invention is described in the context of its use with a commercial refrigeration system manufactured by Tyler Refrigeration Corporation, assignee of the present invention, and sold by Tyler under the tradename "TWOSOME" and which commercial system is described in detail in Tyler Installation and Service Manual for Twosome Condensing Unit Assemblies REV. 5/78. In the Twosome assembly, a pair of compressors is connected in parallel, as shown, for example, in U.S. Pat. No. 4,286,437. It should be understood, however, that the invention is not limited to the Twosome assembly; the present invention may be incorporated into and is applicable to all types of closed cycle refrigeration systems having multiple, parallel operated compressors.

In a closed curcuit refrigeration system of the type described herein, the "high side" refers to the high pressure side of the system (upstream of the metering device) or portion thereof. The liquid side of the system is generally considered to be between the outlet of the condenser and the metering device. The low pressure gas side or "suction side" is located between the metering device and the compressor. The metering device referred to herein is the device that controls the flow of liquid refrigerant to the evaporators and is normally called an expansion valve.

Figure 1:
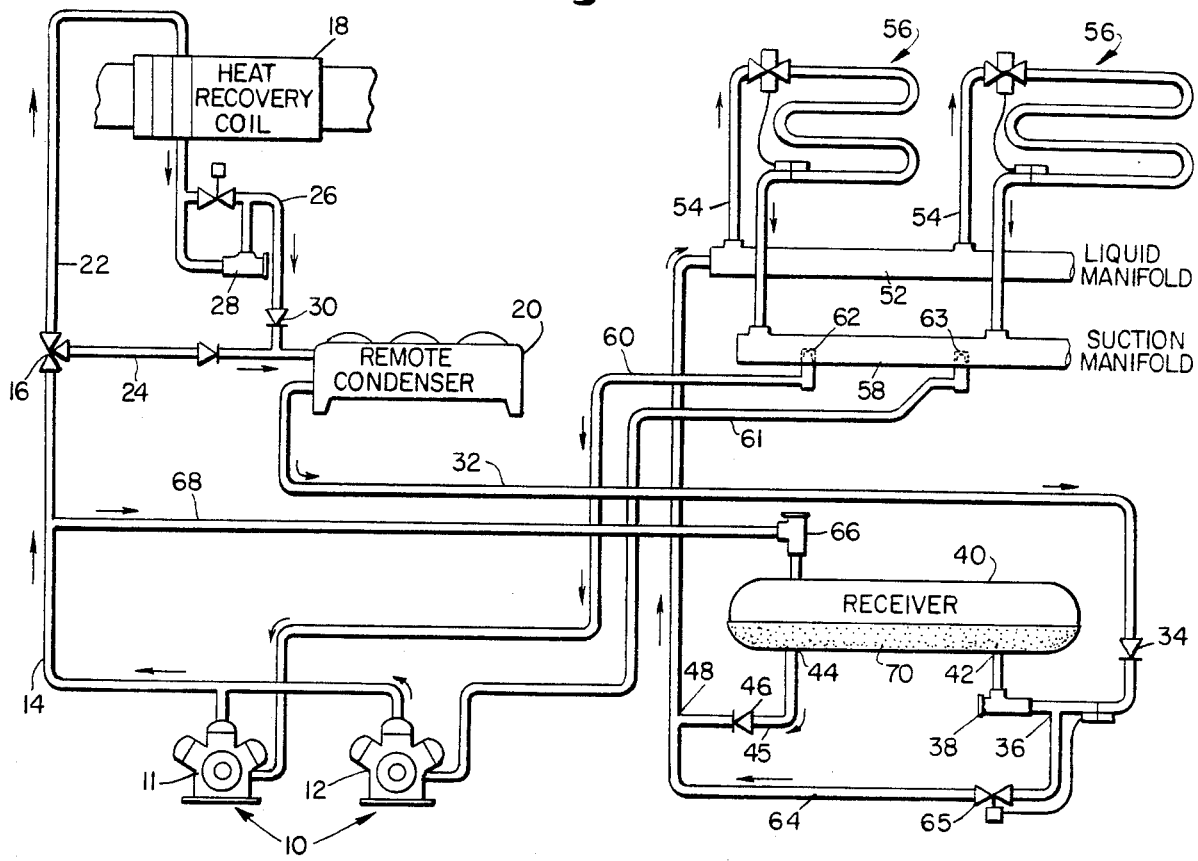
FIG. 1 shows a diagramatic sketch of a closed circuit mechanical refrigeration system having the oil return system of the present invention provided therein.

As illustrated in FIG. 1, a refrigeration system includes compressor means 10 having two compressors 11 and 12 connected to a main compressor discharge gas conduit 14. A solenoid operated three-way heat recovery valve 16 may be advantageously interposed in conduit 14 to selectively connect a heat recovery coil 18 in series flow relationship with a remote condenser 20. Condenser 20 can include a plurality of fans controlled by ambient conditions, as described, for example, in aforementioned U.S. Pat. No. 4,286,437. Valve 16 connects conduit 14 to the upstream side of coil 18 through a heat recovery branch conduit 22 and to the upstream side of remote condenser 20 through a conduit 24. The downstream side of heat recovery coil 18 is connected to conduit 24, and thus remote condenser 20, by a conduit 26 containing a pressure regulator 28 and a check valve 30.

The downstream side of remote condenser 20 is connected through a conduit 32, a check valve 34, a Tee connection 36 and a holdback or upstream pressure regulator 38 to the bottom of receiver tank 40. Unlike conventional designs, the receiver tank 40 of this refrigeration system has both its inlet 42 and outlet 44 located at the bottom of the tank 40.

A receiver outlet conduit 45 of this system is connected through a check valve 46 and a Tee connection 48 to a liquid manifold 52. One or more liquid lines 54 connect the liquid manifold 52 to each of one or more remotely located evaporators 56 associated, for example, with respective refrigerated display cases or cold rooms, generally in a store such as a supermarket. The low side of each evaporator returns to a suction manifold 58 which in turn is connected through separate suction lines 60 and 61 to the intakes of compressors 11 and 12, respectively.

The suction lines 60 and 61 are connected to suction manifold 58 through oil pick-up devices 62 and 63, respectively, which are described in detail below. These devices are a central feature of the oil return system of the present invention and can be used with all types of refrigeration systems having suction manifolds and a plurality of compressors. This system is described below for use with the specific refrigeration system shown in FIG. 1.

During operation of the refrigeration system of FIG. 1, oil from the crank cases of compressors 11 and 12 is entrained with the hot refrigerant gas being moved through discharge gas conduit 14 and thereafter through the heat recovery coil 18 and the remote condenser 20. This entrained crank case oil is moved in conduit 32 to the receiver 40 from which it is then transported by receiver outlet conduit 45 into the liquid manifold 52. The liquid refrigerant is then expanded through the evaporators 56 and into the suction manifold 58. The oil which is entrained through the evaporators 56 tends to accumulate in the bottom of the suction manifold and the oil pick-up devices 62 and 63 then permit the functioning of the oil return system of the present invention. The compressor oil which is contained within the bottom portion of suction manifold 58 is only returned to the suction lines 60 and 61 responsive to the flow of refrigerant gas in the respective line. This selective flow of compressor oil is modulated by the oil pick-up devices 62 and 63. This oil return system therefore provides for the return flow of compressor oil only to a working compressor. This oil return system therefore avoids the over filling of the compressor crank case of a compressor which is not in operation. For example, in the event of a low refrigeration loading on either or both of the evaporators 56, the system could be operated with only compressor 11 in operation. This would then result in a return flow of refrigerant gas only in suction line 60 which then would permit a return of compressor oil by the oil pick-up device 62. Since no refrigerant gas flow would then occur in suction line 61, the oil pick-up device 63 would not operate to permit return oil flow. A description of the operation of the entire refrigeration system described herein will aid in an understanding of the present invention.

The refrigeration system of FIG. 1 further includes a bypass line 64 coupled to Tee connections 36 and 48. A temperature operated solenoid valve 65 is interposed in bypass conduit 64 to control the flow of refrigerant therethrough as a function of the temperature of the liquid refrigerant in the conduit 32 connecting remote condenser 20 and receiver tank 40.

Liquid refrigerant from the remote condenser 20 passes through holdback regulator 38 which establishes and maintains a desired condenser head pressure, depending on such factors as the type of refrigerant used and the system ambient design conditions. From the holdback regulator 38, the liquid refrigerant flows into receiver 40 through bottom inlet 42, and flows along the bottom of the receiver to the bottom outlet 44 located at or near the opposite end of the tank from the inlet 42.

Proper operation of the closed circuit refrigeration system requires that the pressure of the refrigerant be maintained at an appropriately preselected minimum pressure level, depending on the type of refrigerant used, the operating conditions, and the size of the system. Pressure in the receiver tank 40 is maintained by a pressure regulator valve 66 interposed in a conduit 68 which connects the output of compressor 10 with the top of receiver 40. Hot gaseous refrigerant at the compressor output pressure can thus be supplied through conduit 68 and pressure regulator valve 66 to the receiver 40 whenever the pressure in the receiver tank 40 drops below a preselected level. For example, valve 66 may be set to open when the pressure in the receiver 40 drops below 120 psig for refrigerant R-502 or below 55 psig for refrigerant R-12.

The remote condenser 20 is usually located in an exterior environment exposed to outside ambient conditions, such as on the roof of a store. At certain times of the year, such as fall, winter and spring seasons, and/or in certain geographic regions, such as the northern half of the United States, the ambient temperature conditions are sufficiently low that hot gaseous refrigerant entering the remote condenser 20 is completely condensed and subcooled (below the condensing or saturation temperature for the refrigerant in use) within the condenser itself so that refrigerant flowing through conduit 32 is subcooled before entering receiver 40. The solenoid operated valve 65 senses the temperature of the subcooled liquid refrigerant flowing through conduit 32. When the sensed temperature is below a predetermined set point, again determined as a function of the type of refrigerant, size of the system, etc., valve 65 is opened to complete a low resistance refrigerant flow path from the outlet of condenser 20 through conduits 32 and 64 to the inlet side of liquid manifold 52. In this way, subcooled liquid refrigerant at the system head pressure flows directly from condenser 20 to the expansion valves or similar metering device, associated with each of the respective evaporators 56. The predetermined or preselected set point temperature can be about 60 degrees F. so that the liquid refrigerant will pass through the receiver 40 when its temperature is above this point.

The check valve 34 located between the outlet or remote condenser 20 and the Tee connection 36 operates in conjunction with the holdback regulator 38 when receiver tank pressure is low to maintain condenser flooding, thereby assuring system head pressure and subcooling within the condenser. The check valve 34 offers a means of providing adequate head pressure for feeding the expanssion valves of the respective evaporators 56.

The check valve prevents refrigerant from flowing back to the condenser from the evaporators during off cycle periods of the compressors 10. It has been found that, on occasion, during off cycle periods of the compressor means 10, particularly in systems incorporating gas defrost, such as shown, for example, in U.S. Pat. No. 4,276,755, issued July 7, 1981, titled GAS DEFROST SYSTEM INCLUDING HEAT EXCHANGE, and commonly assigned with the present invention, that the refrigerant in manifold 52 will be at a higher temperature and pressure than the refrigerant in condenser 20. The design of regulator 38 is such that it has a relatively slow response time under back pressure conditions. Thus, regulator 38 will be slow to close when the refrigerant pressure on the downstream side of regulator 38 exceeds the refrigerant pressure on the upstream side thereof. A back flow condition will therefore occur for a substantial period of time whereby relatively high temperture refrigerant will flow back to condenser 20, thereby reducing its effectiveness. The check valve 34 is therefore employed to prevent such back flow from occurring during the off cycle phases of the compressor means 10.

The check valve 34 assumes added importance in connection with the present invention since, when solenoid valve 65 is held open, back flow could readily occur through bypass conduit 64, in the absence of check valve 34.

A check valve 46 connected between the receiver outlet 44 and the Tee 48 isolates the receiver tank 40 during the refrigeration mode when the bypass solenoid valve 65 is open and subcooled liquid refrigerant at the system head pressure is flowing through conduit 64 to the liquid manifold 52. Preferably and advantageously, the receiver bypass system head pressure is maintained at about 90 psig for refrigerant R-12 and about 135 psig for refrigerant R-502.

When the temperature of the condensed refrigerant rises above the range of subcooling, solenoid operated valve 65 will close and the condensed refrigerant will be directed into the receiver tank 40. This is to ensure an adequate supply of refrigerant during the condensing mode when total condensing surface is being utilized, with little or no flood back control, allowing for a reserve liquid supply (in the receiver). This is particularly useful in those systems with refrigerant control by thermostat and solenoid, requiring pump down after temperature satisfaction within the display case fixture or during defrosting of the case fixture.

The refrigeration system shown in FIG. 1 permits the delivery of refrigerant under pressure to the evaporators 56 by means of the connection of the condenser output line 32 to the liquid manifold 52 through the controlled valve 65. Thus refrigerant, under the above-described conditions, is permitted to bypass the receiver 40. The connection of the receiver inlet line 42 to condenser output conduit 32 at Tee connection 36 is upstream from valve 65 and the holdback regulator 38 is thus located downstream from that connection Tee 36.

The use of a receiver tank having both the inlet and outlet located at the bottom is based on a recognition of the fact that the receiver tank is generally located in a mechanical machine room, where it is exposed to temperatures ranging between about 65 degrees F. and about 110 degrees F. The bottom portion of the receiver tank is covered by insulation jacket 70 to minimize heating of the subcooled liquid refrigerant flowing through the receiver tank to the higher ambient conditions in the machine room.

In operation of the refrigeration system shown in FIG. 1 and described above, the flow of compressor oil which has been entrained in the refrigerant moving through the closed circuit system into the suction manifold 58 has been found to be particularly heavy during a defrosting operation of either a gas defrost type, as set forth above, or an ambient air defrost in which the compressors 11 and 12 are not operated. This heavy return oil flow results in a build-up of the compressor oil in the bottom of the suction manifold 58. If the oil pick-up means 62 and 63 described herein are not employed a continuous flow of oil can occur in both of suction lines 60 and 61, even though these are not operated since the suction manifolds are normally positioned physically above the heavier compressors 11 and 12. In refrigeration loading situations were compressor 12 is not operated for long time periods, such a flow can result in overfilling of the crank case of that compressor. Upon start-up of compressor 12 damage can occur.

Figure 2:
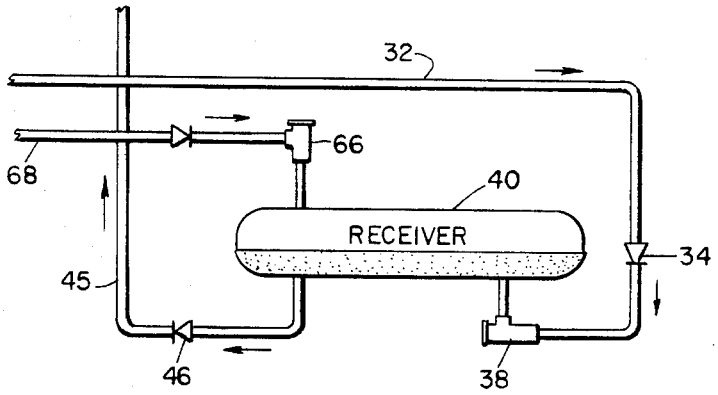
FIG. 2 shows a modification of the receiver means and the associated conduits within box A shown in FIG. 1.

If desired the closed circuit refrigeration system shown in FIG. 1 and described above can be modified so that the by-pass line 64 is omitted. Such an arrangement is shown in FIG. 2 wherein the refrigerant condensed liquid line 32 is connected directly to a holdback regulator 38 so that all of the condensed liquid is put through the receiver 40. The outflow of the liquid refrigerant is through the receiver outlet conduit 45 which has a check valve 46 interposed therein. The conduit 68 which connects the discharge gas conduit to the pressure regulator valve 66 is as shown in FIG. 1. Such a receiver connection arrangement then provides for functioning of the closed circuit refrigeration system without a liquid refrigerant by-pass of the receiver even though the temperature of the subcooled liquid in conduit 32 may be low enough so that a by-pass arrangement could be employed.

Figure 3:
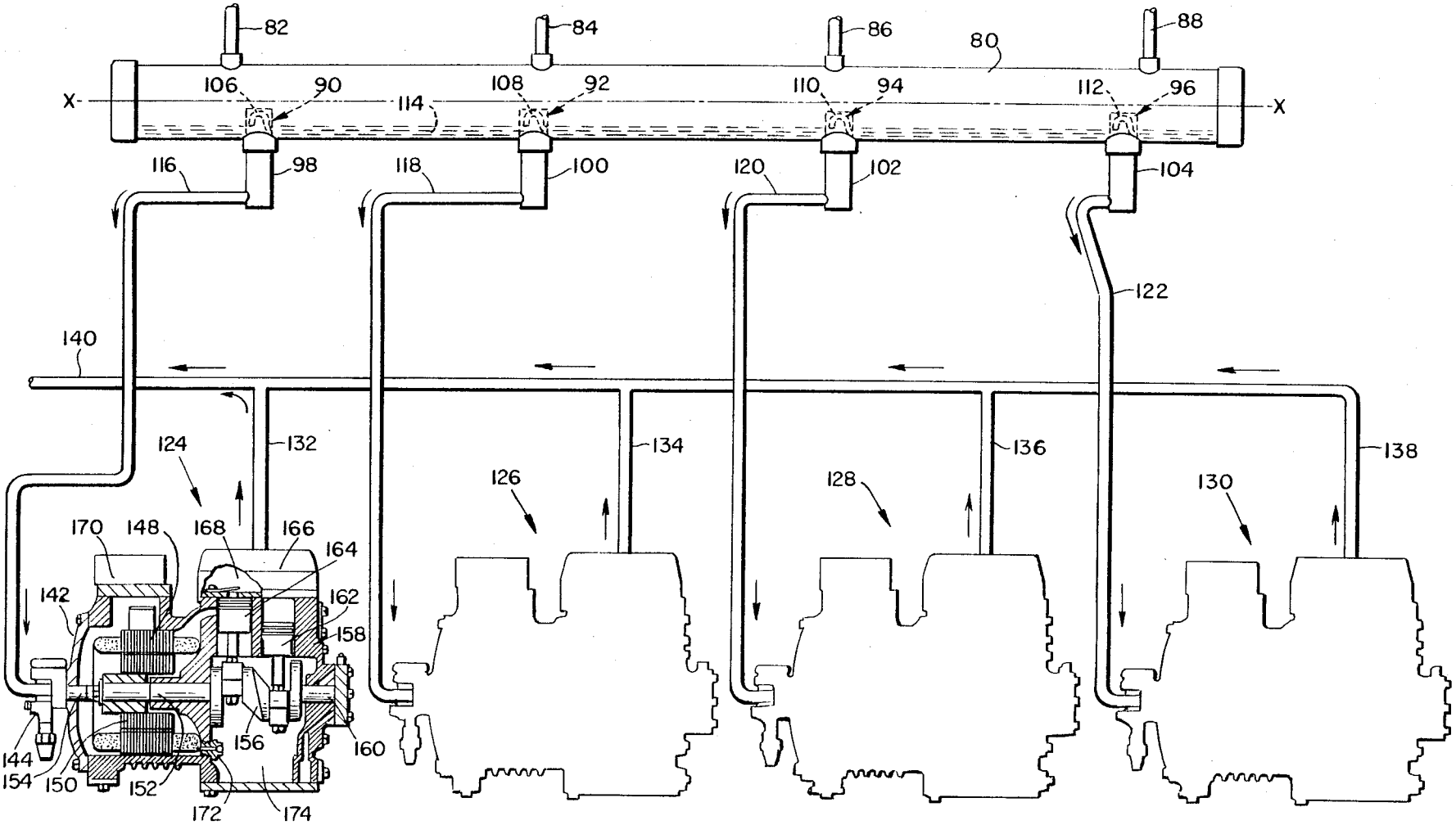
FIG. 3 shows an enlarged diagramatic view of the suction manifold of the closed refrigeration system of the present invention in which the oil return system is shown in detail, including a diagramatic cross-sectional view of one of the compressors with its associated motor.

FIG. 3 shows a suction manifold 80 positioned in a refrigeration system having four different evaporator return lines 82, 84, 86, and 88 through which gaseous refrigerant flows during operation of those associated evaporator coils which are not shown but which would be similar to evaporators 56 shown in FIG. 1. Also connected to the bottom of the suction manifold 80 are a series of oil pick-up devices, 90, 92, 94, and 96. Each of these oil pick-up devices consist of a suction drop sleeve 98, 100, 102, and 104, respectively, which extends upwardly into the bottom portion of manifold 80 so that the top of the sleeves are adjacent to the central axis X—X thereof. Also each of these oil pick-up devices are formed with an oil pick-up tube 106, 108, 110, and 112 located within the top portion of the suction drop sleeves, respectively. The oil pick-up tubes have an opening in the side wall of their respective suction drop sleeves which is located near the bottom portion of manifold 80 and an outlet end which is located on the opposite end of each of the tubes and which is oriented in a downward direction within the respective suction drop sleeves. Upon flow of gaseous refrigerant downwardly through the suction drop sleeves the oil pick-up tubes 106, 108, 110 and 112 function as venturi tubes due to the velocity of the refrigerant gas downwardly past the open end thereof and compressor oil which is shown as oil film or reservoir 114 is siphoned out of the bottom portion of manifold 80 and is entrained in the downwardly moving refrigerant gas flow. In this manner the return oil flow in each of the suction lines 116, 118, 120 and 122 is operative only during those times when the individual lines are conducting the flow of gaseous refrigerant.

A series of four compressor-motor units 124, 126, 128 and 130 have been shown connected to the suction lines 116, 118, 120 and 122, respectively. The discharge gas lines 132, 134, 136, and 138 are connected to a discharge main 140 which conducts the hot compressed refrigerant gas in the high pressure side of the refrigeration circuit in which the suction manifold 80 and the compressor-motor combinations are connected. It is, of course, possible to have either two, three, four or more of these compressor-motor combinations in order to employ the oil return system of the present invention.

As shown by the compressor-motor unit 124, the suction line 116 is connected to the motor casing 142 through a suction valve 144 and the returning gaseous refrigerant is used to cool the motor coils 148 and 150, the latter of which is mounted on a rotor 152 which is operated within a bearing 154 and is connected to a crank shaft 156 on the other end thereof. The crank shaft 156 is journaled within compressor housing 158 by a bearing 160 and is in turn connected to a first piston and piston rod combination 162 and a second piston and piston rod combination 164 which operate within their respective cylinders 166 and 168 to compress the refrigerant gas which is fed thereinto when the pistons are at the lower portion of their respective reciprocal movements. The valving in the compressor and the motor control 170 are of standard types employed in such combination units. A ball check valve 172 is provided at the bottom of the motor housing 142 to permit crank case oil to flow from the suction line 116 into the bottom of the crank case 174 within the compressor housing 158.

If an oil pick-up device such as 90 were not employed for suction line 116, oil could drain continuously from the suction manifold through line 116 and into the motor housing 142 through the ball check valve 172 and into the compressor crank case 174 such that the crank case would become overfilled with oil and damage to the unit 124 could occur upon start-up. By the provision of the oil pick-up device 90, 92, 94, and 96 protection against this return oil flow problem is provided for each of the units 124, 126, 128, and 130 so that these expensive units are not damaged by overfilling with crank case return oil.

In the partial system shown in FIG. 3 each of the units 124, 126, 128, and 130 have similar components to those illustrated with respect to unit 124. In the event that one or more of these compressor-motor units is not operated due to a low refrigeration loading on the system in which these units are employed, the non-operated units will not receive a flow of return oil flow since the oil pick-up tubes only permit a flow in response to the flow of gaseous refrigerant through the respective suction drop sleeves.

In FIG. 3 the gas discharge main 140 corresponds to the discharge gas conduit 14 of the refrigeration circuit shown in FIG. 1, and the gaseous refrigerant return lines correspond to the return lines for evaporators 56 shown in FIG. 1 entering the suction manifold 58.

Figure 4:
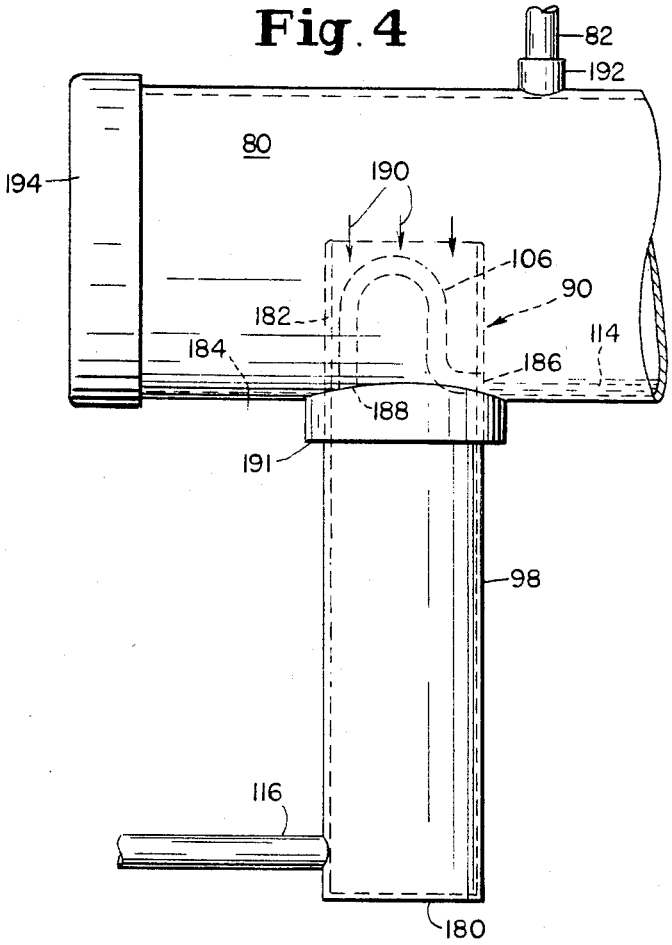
FIG. 4 is an enlarged view of one of the oil pick-up means installed in a suction manifold of a closed circuit refrigeration system.

In the enlarged view of the oil pick-up device 90 shown in FIG. 4, the suction drop sleeve 98 is shown as an enlarged sleeve having a closed bottom 180 and an upwardly extending sleeve portion 182 which is contained within suction manifold 80. The oil pick-up tube 106 is shown connected near the bottom portion 184 of manifold 80 through the side wall of the sleeve portion 182 so that it has an opening 186 extending through the sidewall. The opposite end of the oil pick-up tube 106 has an opening 188 positioned in a downward direction so that the flow of refrigerant gas illustrated by arrows 190 will cause a suction pressure on the outlet 188 whereby within the oil film 114 located in the bottom portion of manifold 80 will be lifted upwardly through the tube and will flow out of the opening 188 and into the gaseous refrigerant stream moving within the suction drop sleeve 98.

In a preferred embodiment the suction manifold 80 can have a diameter of between 4–6 inches and when the smaller of these diameters is employed a suction drop sleeve having a length of approximately 9 inches and an OD of approximately $2\frac{1}{8}$ inches. The horizontal width of the arcuately formed oil pick-up tube 106 can be $1\frac{7}{8}$ inches and the distance which the arcuate oil pick-up tube 106 rises from its bottommost position of connection with the sidewall of the suction drop sleeve can be $1\frac{3}{4}$ inches. The tube 106 can be $\frac{1}{4}$ inch O.D. copper tubing. It is preferred to position the outlet opening 188 near the vertical position of the intake opening 186, although other vertical positionings may be utilized.

The suction drop sleeve 98 is shown with a fitting collar 191 connected therearound for fitting with the curved bottom surface of the manifold 80. Also shown is a similar collar fitting 192 for the return gaseous refrigerant line 82. Such collars are also provided for the other suction drop sleeves 100, 102, and 104, and for the return gas lines 84, 86, and 88, respectively. An end cap 194 is shown on the manifold 80.

Figure 5:
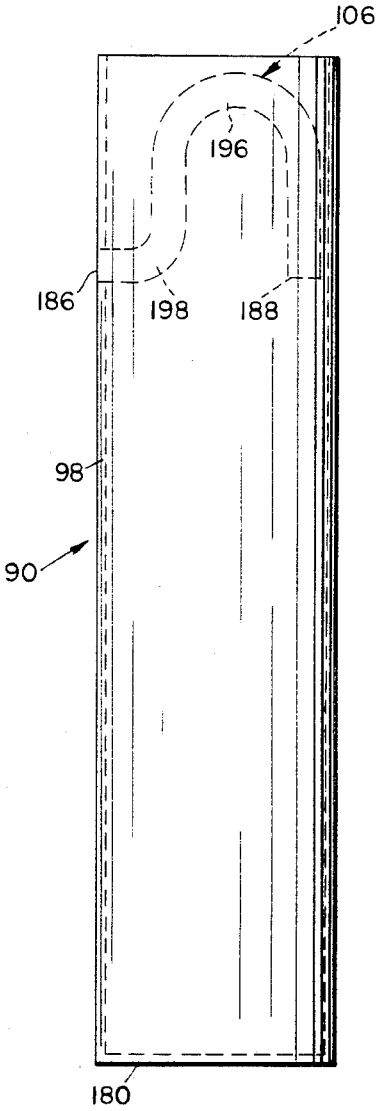
FIG. 5 shows a side view of an oil pick-up tube of the present invention installed within its associated suction drop sleeve.
Figure 6:
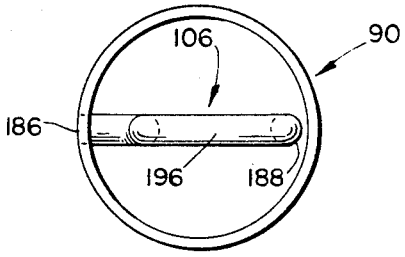
FIG. 6 shows an end view of the oil pick-up tube and sleeve shown in FIG. 5.

FIG. 5 shows the preferred form of the suction drop sleeve 98 having the oil pick-up tube 106 mounted therein and extending through the sidewall thereof to form an inlet opening 186 and having an outlet opening 188 as described above. FIG. 6 shows an end view of the oil pick-up device 90 with the oil pick-up tube 106 mounted therein, wherein the arcuate upper portion 196 can clearly be seen. The bottom curved portion 198 of the tube 106 can be clearly seen in FIG. 5. The combination of the suction drop sleeve 98 and the oil pick-up tube 106 then form the oil pick-up device 90 of the present invention and can be manufactured and sold as a separate device for improving manufacture of refrigeration systems having multiple compressors therein.

As described by reference to FIGS. 3 and 4, the oil pick-up portions of the devices 90, 92, 94 and 96 are contained within the suction manifold 80. Only the bottom portion of the suction drop sleeves 98, 100, 102 and 104 extend below the manifold. The oil pick-up tubes 106, 108, 110, and 112 are entirely contained within the upper portions of the suction drop sleeves and the suction manifold so that refrigerant gas leakage is not permitted. This reduces possible leakage from the oil return system of the present invention to a practical minimum. This construction permits secure connections about the collar 191 of FIG. 4 and between the suction line 116 and the drop sleeve 98.

The invention may be embodied in other specific forms without departing from the spirit of essential characteristics thereof. The present embodiment is therefore to be considered in all aspects as illustrative and not restrictive, the scope of the invention being indicated by the appended claims rather than by the foregoing description, and all changes which come within the meaning and range of equivalency of the claims are therefore intended to be embraced therein.

What is claimed is:

1. In a refrigeration system having multiple compressors for compressing a refrigerant fluid, an oil return system for conveying oil entrained in circulating refrigerant fluid back to the compressors, comprising a suction manifold common to the compressors, in which the entrained oil is trapped;

suction lines connecting a suction port on each compressor in fluid communication with the common suction manifold; and a plurality of oil pick-up means for drawing oil trapped in the common suction manifold into the suction line connected to any compressor that is in use and thereby operative to return the trapped oil to an operating compressor in the refrigeration system, while avoiding oil return to an inactive compressor.

2. The oil return system of claim 1 wherein the oil pick-up means include a suction drop sleeve disposed on the suction manifold where the suction line is connected.

3. The oil return system of claim 2 wherein the oil pick-up means further include a venturi tube that has one open end exposed to the flow of refrigerant fluid through the suction drop sleeve and another open end disposed in the suction manifold where the oil is trapped.

4. The oil return system of claim 3 wherein at least a portion of the venturi tube is above the level of oil trapped in the suction manifold.

5. In a refrigeration system having multiple compressors for compressing refrigerant fluid, a condenser for condensing compressed refrigerant fluid, an evaporator for vaporizing the condensed fluid, and a suction manifold connected between the evaporator and the compressors by suction lines that provide a separate return path for refrigerant fluid from the common suction manifold to each of the compressors, an oil return system for conveying oil trapped in the suction manifold back to the compressors, comprising separate oil pick-up means associated with each separate suction line leading from said suction manifold to a connected compressor, for drawing oil trapped in the suction manifold into the suction line for return to the connected compressor, wherein said oil pick-up means include a venturi that only draws oil into the suction line if the connected compressor is in use, whereby oil is preferentially returned to an operating compressor rather than an inactive compressor.

6. The oil return system according to claim 5, wherein said system comprises at least three compressors, suction lines connecting said compressors to said suction manifold, and oil pick-up means.

7. The oil return system according to claim 5, wherein said multiple compressors are capable of operating independently of one another for handling variable refrigeration loads.

8. In a refrigeration system having multiple compressors for compressing a refrigerant fluid, a condenser in which the compressed fluid is condensed, an evaporator for vaporizing the condensed fluid to provide refrigeration, and a suction manifold in which oil entrained in the vaporized refrigerant is trapped, a method for conveying the oil trapped in the suction manifold through separate suction lines connected to the suction manifold back to the compressors and for preventing excessive oil return to an inactive compressor, said method comprising the steps of:

selectively operating the multiple compressors, depending upon the refrigeration load; and drawing oil trapped in the suction manifold back into an operating compressor through a venturi tube associated with the suction line connected to that compressor, whereby oil is only returned to operating an operating compressor and not to an inactive compressor.

9. The method according to claim 8, wherein the flow of refrigerant gas through the suction line connected to the operating compressor creates a reduced pressure at an inlet to the venturi to draw oil up out of the suction manifold and into the suction line to the connected compressor.

10. In a refrigeration system having multiple compressors for compressing refrigerant fluid, a compressor discharge conduit for conducting compressed refrigerant gas to a condenser means in which the compressed refrigerant gas is condensed; and evaporator means connected between said condenser means and a suction manifold to provide refrigeration by evaporating liquid refrigerant from said condenser means; said suction manifold connected to the intake of said multiple compressors by separate suction lines for each of said compressors for returning the refrigerant gas formed to the compressor; and control means for operating said multiple compressors individually dependent upon refrigeration load imposed upon said refrigeration system; the improvement comprising:

a plurality of suction drop sleeves interconnected between said suction manifold and said suction lines, each of said suction drop sleeves extending into said suction manifold and providing a controlled flow channel for flow of the refrigerant gas into the associated suction line; and an oil pick-up means associated with each of said sleeves having an intake opening thereof located in communication with the bottom-most area of the interior of the suction manifold and having an outlet opening located within the associated suction sleeve tube, said oil pick-up means permitting the flow of oil therethrough responsive to flow of refrigerant gas through said associated suction line.

11. The improvement in a refrigeration system according to claim 10, wherein said oil pick-up means comprise a venturi tube having the outlet end thereof positioned in a downstream orientation with respect to the flow of refrigerant gas through said suction drop sleeve.

12. The improvement in a refrigeration system according to claim 10, wherein said multiple compressors are capable of operating independently of one another for handling variable refrigeration loads.

13. A refrigeration system having multiple compressors for compressing refrigerant fluid, a compressor discharge conduit for conducting compressed refrigerant gas to a condenser means in which the compressed refrigerant gas is condensed; and evaporator means connected between said condenser means and a suction manifold to provide refrigeration by evaporating liquid refrigerant from said condenser means; and said suction manifold connected by separate suction lines to the intakes of said multiple compressors for returning the refrigerant gas formed in said evaporator means to said multiple compressors; and control means for individually operating said multiple compressors depending upon refrigeration load imposed upon said system; comprising:

a plurality of suction drop sleeves interconnected between said suction manifold and said suction lines, said suction drop tube extending into said suction manifold and providing a controlled flow channel for flow of the refrigerant gas into the associated suction line; and an oil pick-up means associated with each of said sleeves having an intake opening thereof located in communication with the bottom-most area of the interior of the suction manifold and having an outlet opening located within the suction drop sleeve, said oil pick-up means permitting the flow of oil therethrough responsive to flow of refrigerant gas through said associated suction drop sleeve.

14. The refrigeration system according to claim 13, wherein said suction drop sleeves comprise a cylindrical cannister mounted in the bottom portion of said suction manifold and having a diameter sufficient to accommodate the positioning of said oil pick-up means therein, said suction drop sleeves extend upwardly into the interior of said suction manifold a substantial distance; and each of said oil pick-up means comprising a venturi tube having an intake opening passing through the wall of said suction drop sleeve adjacent to the portion of said sleeve connected to the bottom portion of said suction manifold so as to be in communication with the interior bottom area of said suction manifold, and said venturi tube having the outlet end thereof positioned in a downstream location from the highest-most portion of said venturi tube.

15. A refrigeration system according to claim 14, wherein each of said venturi tubes extends from its connection through the wall of said suction drop tube upwardly within said sleeve and wherein said venturi tube has an arcuate upper portion which curves downwardly within said suction drop tube and positions the outlet opening thereof in a downstream position from the uppermost portion of said venturi tube.

16. A refrigerant system according to claim 14, wherein each of said venturi tubes is located within said suction drop sleeve and is positioned internally in said suction manifold above the bottom.

17. A refrigeration system according to claim 13, wherein said control means operates said multiple compressors independently of one another for handling variable refrigeration loads and wherein said oil pick-up means associated with said suction lines enables oil flow from the bottom portion of said suction manifold into said suction lines dependent upon the flow of refrigeration gas therethrough whereby oil is conducted to the separate compressors of said multiple compressors in response to periodic operation thereof.

18. A refrigeration system according to claim 13, wherein said oil pick-up means has the intake opening and the outlet opening thereof located within said suction manifold.

* * * * *